United States Patent [19]

Korger

[11] 3,992,031

[45] Nov. 16, 1976

[54] SAFETY SKI-BINDING

[75] Inventor: Heinz Korger, Munich, Germany

[73] Assignee: Hannes Marker, Garmisch, Germany

[22] Filed: Apr. 29, 1975

[21] Appl. No.: 572,824

[30] Foreign Application Priority Data

May 6, 1974 Germany ..... 2421754

[52] U.S. Cl. ..... 280/618; 280/636

[51] Int. Cl.[2] ..... A63C 9/081

[58] Field of Search ..... 280/11.35 K, 11.35 C, 280/11.35 R, 11.35 D, 11.35 E, 11.35 A, 618, 620, 633, 636

[56] References Cited

UNITED STATES PATENTS

| | | | |
|---|---|---|---|
| 3,731,944 | 5/1973 | Salomon | 280/11.35 C |
| 3,773,344 | 11/1973 | Wilkes | 280/11.35 C |
| 3,874,685 | 4/1975 | Besser | 280/11.35 K |

*Primary Examiner*—M. H. Wood, Jr.
*Assistant Examiner*—David M. Mitchell
*Attorney, Agent, or Firm*—Fleit & Jacobson

[57] ABSTRACT

In a safety ski-binding where the ski boot is connected to the ski by a sole plate which is releasably held to the ski by retaining means, any undesirable play between said retaining means and the sole plate that might be caused by manufacturing tolerances, inaccuracies in assembly and the like is compensated by the provision in a recess of the sole plate of at least one slide member which passes therethrough and is vertically displaceable relatively thereto within limits, the lower end of the slide member resting on the ski and the sole of the boot coming to lie on the upper end.

5 Claims, 5 Drawing Figures

1
2
3
4
5
6
9
10
11
12
13
14
15
16
I
II

SAFETY SKI-BINDING

The invention relates to a safety ski-binding in which the connection between the ski boot and ski is effected by way of a special sole plate held to the ski by retaining means comprising fittings fixed relatively to the ski, said sole plate retaining means including latching means for releasing the sole plate on the occurrence of an excessive load in the vertical and/or horizontal direction, and wherein the sole plate is adaptable to the height of said fittings for close abutment thereagainst and carries sole depressors for holding the boot stretched and only releasing it on being deliberately actuated.

Known safety ski-bindings of this kind exhibit contacting faces between the fittings fixed to the ski for holding the sole plate to the ski and the movably mounted sole plate. On the one hand, these contacting faces ensure a tight connection between the foot of the skier and the ski, this being a prerequisite for good ski control. On the other hand, the contacting faces should not be pressed on one another too severely so that resetting of the sole plate is not detrimentally influenced by excesive frictional forces and so that jamming of the sole plate is avoided when it is in a swung out condition. With a view to meeting these conflicting requirements for the contacting faces, known safety ski-bindings have been provided with additional means for compensating the play that might occur between the contacting faces as a result of manufacturing tolerances, possible inaccuracies in assembly and possible flexure of the sole plate. Such compensating means which, in the long run, have an effect on the retaining means for the sole plate, are known for example in the binding marketed under the name 'BESSER' and essentially comprise screw-threaded studs which pass through the sole plate. By screwing the studs in or out one or more turns after the sole plate has been mounted, the initially set height of the sole plate relatively to the mountings fixed to the ski is varied and adapted to the height of said fittings.

These compensating means for the sole plate height are disadvantageous in so far that the height setting of the sole plate by means of screw-threaded studs prolongs the procedure of mounting the sole plate and, when the setting is effected other than in the factory, for example on the ski run where there is no testing equipment, it has to be carried out by way of estimation and could unconrollably change the releasing force for the sole plate retaining means. In addition, any solidified snow or dirt that has accumulated between the contacting faces prior to the height setting will give rise to misleading results. Further, there is a danger that the studs may become loose during skiing and thereby cause the sole plate to wobble, which would markedly affect the skier's feeling of security and could even cause him to fall.

It is therefore an object of the invention to avoid these disadvantages and provide simple and unchangeable adaptation of the height of the sole plate to the fittings fixed to the ski, thereby ensuring a tight connection between the foot and the ski that is necessary for good ski control.

According to the invention, a safety ski-binding of the aforementioned kind is characterised in that at least one slide member is provided in a recess of the sole plate, passes therethrough, projects thereabove, and is vertically displaceable relatively thereto within limits, the lower end of the slide member resting on the ski and the sole of the boot coming to lie on the projecting upper end.

When stepping into the safety ski-binding according to the invention, the sole plate is now no longer loaded by weight of the skier because he will stand on the slide member rather than the sole plate. When tensioning or tightening the ski boot, the tightening force exerted by the sole depressors located on the sole plate will first of all act on the sole plate itself. The plate is thereby pulled upwardly, the play between the contacting faces of the fittings is eliminated and an upper surface of the plate comes to lie tightly against the fittings. The sole depressors then continue to bring about the best possible connection between the boot and the ski. In this way the contact with the ski and consequently guiding of the ski are also at an optimum, whereas the initial holding forces in the fittings remain unchanged. Manufacturing tolerances, possible flexures of the sole plate and inaccuracies in assembly are automatically compensated. Again, during actual skiing the plate permanently and unalterably lies closely against the fittings. The construction of the ski-binding according to the invention is simple and subsequent adjustment or adaptation is no longer necessary.

One or more of said slide members may be provided in each of the front and rear zones of the sole plate.

Preferably, at least two said slide members are provided in each of the front and rear zones of the sole plate and the slide members in each zone are integral wih one another. For example, the lower ends of the slide members in each zone may be made in one piece below the sole plate by having a common foot so as to provide a better support for the boot and for better guiding of the boot on the ski when lateral forces occur. It is also possible for the upper ends of the slide members to be made in one piece or for both respective ends to be joined to each other.

It has been found desirable to provide spring means such as a plate spring under the sole plate between the latter and the or each slide member or set of slide members for urging the sole plate upwardly even when the boot is not in place and thereby avoid wobbling or rattling. The spring force should be a fraction of the force of the latching means.

The or each slide member is preferably of hard plastics material and, on the side that slides, has friction reduction properties or is provided with friction reduction means.

An example of the invention will now be described with reference to the accompanying drawings, wherein.

Figures 1, 2:
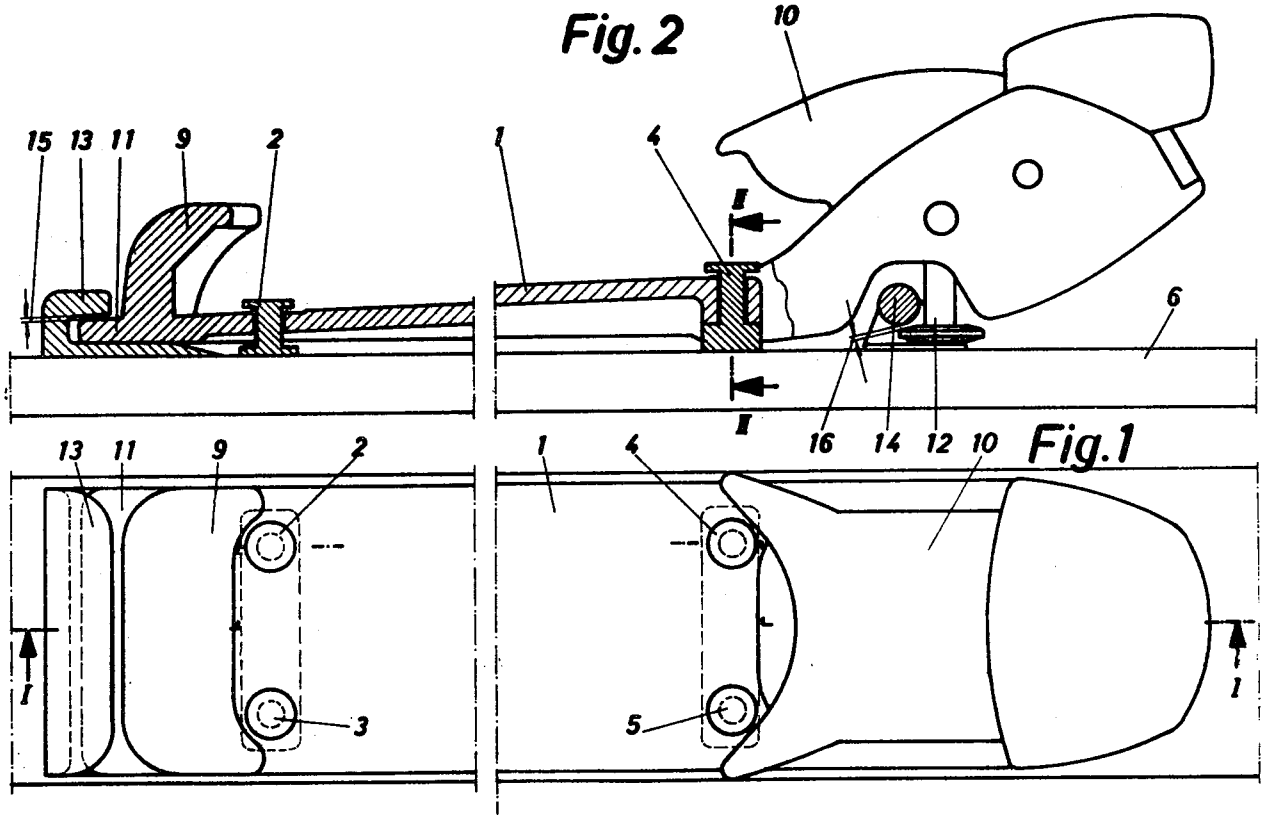
FIG. 1 is a diagrammatic plan view of the front and rear portions of a safety ski-binding with sole plate and slide pieces.
FIG. 2 is section on the line I—I of the FIG. 1 ski-binding when not loaded by a ski boot.
Figure 3:
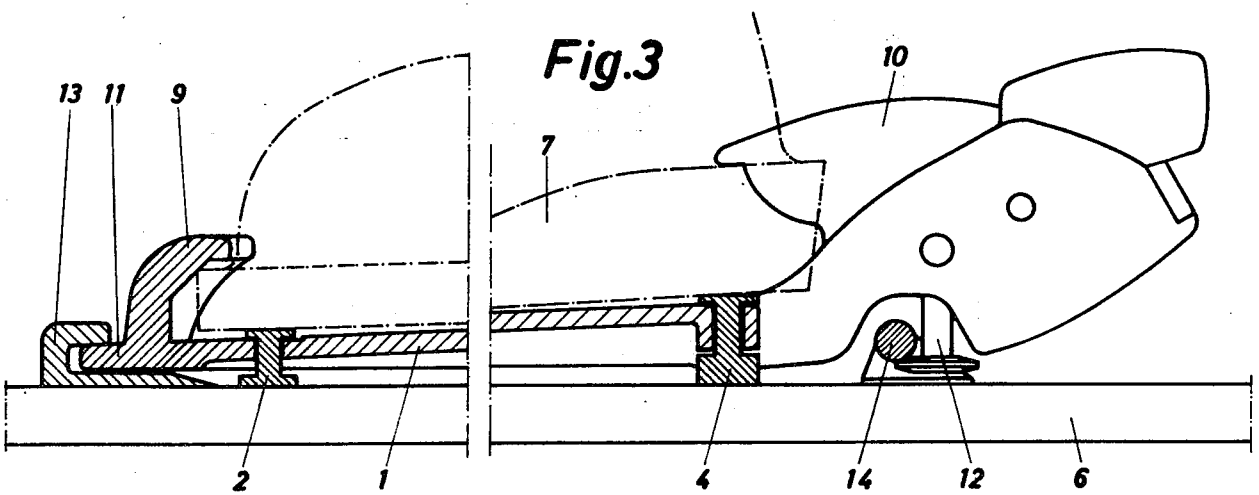
FIG. 3 is a section corresponding to FIG. 2 when loaded by a ski boot which is indicated in phantom lines.

The safety ski-binding of FIGS. 1 and 2 comprises a sole plate 1 carrying a sole depressor 9 at the front and a sole depressor 10 at the back, between which a ski boot can be tightly clamped as shown in chain-dotted lines in FIG. 3 and then only deliberately released. The sole plate 1 is pivotable on the ski 6, for example about a vertical pivot pin (not shown), is provided with a tongue 11 at the front and has a latching member 12 at the back which is effective to release to the plate from the ski on the occurrence of an excessive load. The tongue 11 and latching member 12 engage under respective ski fittings 13 and 14 for holding the sole plate 1 to the ski 6.

Since the sole plate, the sole depressors and the plate retaining means can be of any desirable kind which include fitting elements which overly corresponding elements on the sole plate, that is not of interest to the present invention, a detailed description of these components will be omitted. It need merely be mentioned that in safety ski-bindings having releasable sole plates it is possible for play to exist in the sole plate retaining means, as represented by the gap 15 between the fittings 13 and the tongue 11 and the gap 16 between the fitting 14 and the latching member 12. This play is occasioned by manufacturing tolerances for the contacting portions, inaccuracies in assembly of the parts in question or other factors and have an unfavourable effect on the safety ski-binding. To compensate for this play or rather the gaps 15, 16, the sole plate 1 is provided with slide members 2, 3, 4, 5 having a cylindrical body portion received in recesses of the sole plate, an enlarged foot resting on the ski and an enlarged head projecting above the sole plate. As evident particularly in FIGS. 2, 3 and 4, the slide members 2, 3, 4 and 5 and the sole plate 1 are not movable relatively to one another in the plane of the sole plate 1. However, at right-angles to the sole plate and to the surface of the ski the slide members are freely movable relatively to the sole plate within limits determined by abutments formed by the head and foot of each slide member.

Figure 4:
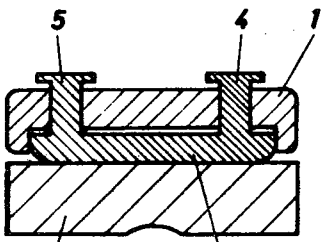
FIG. 4 is a section on the line II—II in FIG. 2.

FIG. 4 shows a preferred construction in which two laterally or longitudinally juxtaposed slide members or posts 2, 3 or 4, 5 are integrally interconnected by having their lower ends fused together to form a common foot 17 beneath the sole plate 1, whereby the slide members or posts are made in one piece.

Figure 5:
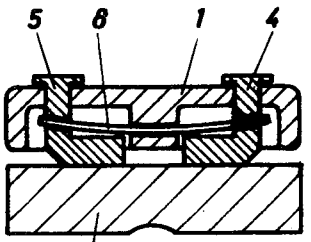
FIG. 5 is a section corresponding to FIG. 4 but showing a further embodiment of the ski-binding.

FIG. 5 shows a different embodiment in which a plate spring 8 disposed between the sole plate 1 and the slide members urges the sole plate upwardly even before a boot is placed in position.

The function of the safety ski-binding according to the invention is best shown by a comparison of FIGS. 2 and 3. FIG. 2 shows the binding before the boot is in position. The sole plate 1 resting on the ski 6 can be moved upwardly without any hindrance by an amount equal to the width of the gaps 15, 16. The spacing between the abutments on the slide members, that is to say the spacing between the head and foot of the slide members is such that the sole plate can move upwardly to the extent of the gaps 15, 16 and lie with its upper surface closely against the fittings 13, 14. The vertical movement of the sole plate on the slide members up to the upper abutments must therefore be at least as large as the gaps 15, 16.

In FIG. 3, a ski boot 7 shown in phantom lines is clamped in position. The sole of the boot lies on the slide members 2, 3, 4, 5 without thereby loading the surface of the sole plate 1.

When placing the boot in position on the sole plate, the tip of the sole is wedged into the front sole depressor 9 and the heel of the boot is loaded by the spring force of the rear sole depressor 10. This causes the sole plate 1 to move upwardly until the upper surface of the tongue 11 and latching member 12 abut against the fittings 13, 14 fixed to the ski. The undesirable play 15, 16 is thereby compensated and the sole plate lies tightly against the fittings.

Whenever the skier steps into the safety ski-binding, the play is compensated automatically.

I claim:

1. A safetly ski-binding of the type wherein a sole plate provides a connection between the ski boot and the ski, the sole plate being held to the ski by retaining means including fittings and latching means for releasing the sole plate upon the occurrence of an excessive load in a vertical and/or horizontal direction, the fittings being disposed at a height above the ski for engagement by corresponding upper surfaces on the sole plate in a vertically adjusted upper position and sole depressors on the sole plate for releasably retaining a ski boot on the sole plate, the improvement which comprises at least one recess in the sole plate, a slide member having a lower end and an upper end disposed in said recess for limited vertical movement relative to the sole plate, said slide member upper end engageable by the sole of a ski boot accommodated within the sole depressors, the sole depressors acting downwardly on the sole of the ski boot, to move the sole plate vertically upward relative to said slide member with said slide member lower end in engagement with the ski for abutting engagement of the corresponding upper surfaces on the sole plate with the fittings in said vertically adjusted upper position of the sole plate.

2. A safety ski-binding according to claim 1, wherein at least one said slide member is provided in each of the front and rear zones of said sole plate.

3. A safety ski-binding according to claim 1, wherein at least two said slide members are provided in each of the front and rear zones of said sole plate, the slide members in each zone being integral with one another by being in one piece at their said lower ends and/or their said projecting upper ends.

4. A safety ski-binding according to claim 1 including spring means disposed between the sole plate and the or each slide member for urging the sole plate upwardly with a force that is a fraction of the force of the latching means.

5. A safety ski-binding according to claim 1, wherein the or each slide member is of hard plastic material and has friction reduction properties or is provided with friction reduction means at least on that portion of its said lower end that rests on the ski or a part fixed to the ski.

* * * * *